US010279593B2

(12) United States Patent
Wan et al.

(10) Patent No.: US 10,279,593 B2
(45) Date of Patent: May 7, 2019

(54) PRINTER AND METHOD FOR DELIVERING INK IN THE PRINTER

(71) Applicant: Hewlett-Packard Development Company, L.P., Houston, TX (US)

(72) Inventors: Sing Yan Wan, Singapore (SG); Michelle Mae Martinito, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/758,894

(22) PCT Filed: Oct. 30, 2015

(86) PCT No.: PCT/US2015/058333
§ 371 (c)(1),
(2) Date: Mar. 9, 2018

(87) PCT Pub. No.: WO2017/074424
PCT Pub. Date: May 4, 2017

(65) Prior Publication Data

US 2018/0250942 A1 Sep. 6, 2018

(51) Int. Cl.
*B41J 2/21* (2006.01)
*B41J 2/175* (2006.01)

(52) U.S. Cl.
CPC ..... *B41J 2/17509* (2013.01); *B41J 2/175* (2013.01); *B41J 2/17566* (2013.01); *B41J 2/21* (2013.01)

(58) Field of Classification Search
CPC .... B41J 2/175; B41J 2/17509; B41J 2/17566; B41J 2/17513; B41J 2/17596
USPC ..... 347/84–86, 89
See application file for complete search history.

(56) References Cited

U.S. PATENT DOCUMENTS

| | | | | |
|---|---|---|---|---|
| 6,174,052 | B1 | 1/2001 | Eremity et al. | |
| 6,874,872 | B2 | 4/2005 | Lewis et al. | |
| 7,758,174 | B2 * | 7/2010 | Karppinen | B41J 2/16585 347/84 |
| 7,771,034 | B2 | 8/2010 | Brown et al. | |
| 8,899,735 | B2 | 12/2014 | Johnson et al. | |
| 9,132,954 | B2 * | 9/2015 | Nilsson | B65D 83/42 |
| 2001/0006395 | A1 | 7/2001 | Pawlowski et al. | |
| 2007/0081052 | A1 | 4/2007 | Lebron et al. | |
| 2008/0273069 | A1 | 11/2008 | Langford et al. | |
| 2010/0214597 | A1 | 8/2010 | Hasseler et al. | |
| 2013/0033552 | A1 | 2/2013 | Chen et al. | |

FOREIGN PATENT DOCUMENTS

| | | |
|---|---|---|
| WO | WO-02076750 | 10/2002 |
| WO | WO-2009049349 | 4/2009 |

* cited by examiner

*Primary Examiner* — An H Do
(74) *Attorney, Agent, or Firm* — HP Inc. Patent Department

(57) ABSTRACT

A printer and a method for delivering ink in the printer are disclosed. The printer, comprising an ink supply station (ISS) having a first pump and an ink tank coupled to the ISS, wherein the ink tank comprises a first inflatable bag; a print head having an off-axis ink supply unit and a second pump coupled to the print head, wherein the off-axis ink supply unit comprises a second inflatable bag; and a connection unit which connects the ISS to the off-axis ink supply unit.

9 Claims, 3 Drawing Sheets

PRINTER AND METHOD FOR DELIVERING INK IN THE PRINTER

BACKGROUND

A printer is a device used to print electronic text or image on a physical medium which may be a 2-dimensional (2D) or 3D printing target. Inkjet printing is a type of printing that reproduces a digital image by propelling droplets of printing fluid, such as ink, onto paper, plastic, or other medium. The CMYK (cyan, magenta, yellow, black) color model may be used in inkjet printing.

A printer model may be based on the amount of ink supply and may be adapted to the application of inkjet printing. For example, large format applications use large size printing media and may use ink supplies greater than office printers or home printers. Examples of large format applications include computer aided design like engineering drawings, mapping, graphic arts, and posters.

DETAILED DESCRIPTION

Figure 1:
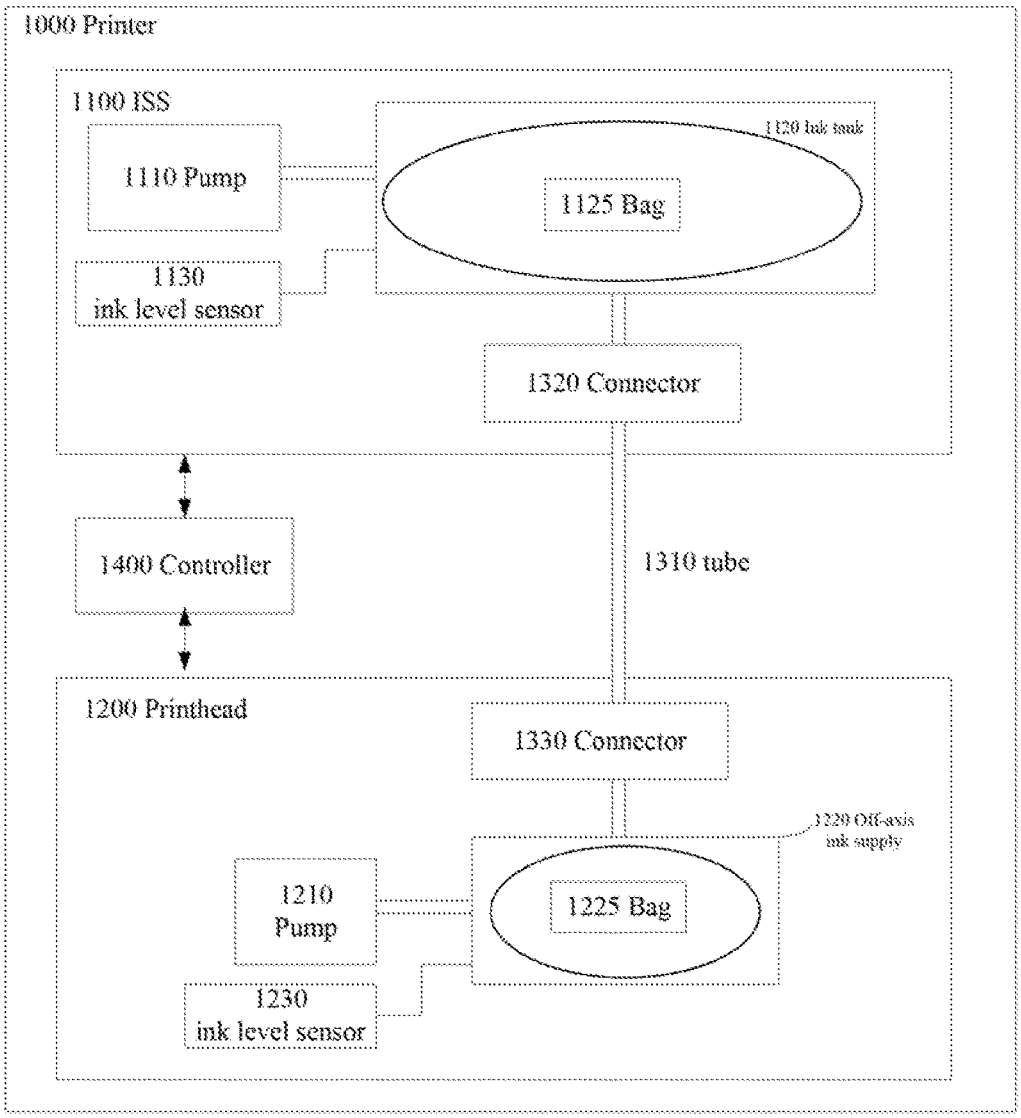
FIG. 1 shows a schematic structure of a inkjet printer according to an example.

FIG. 1 shows a schematic structure of an inkjet printer 1000 according to an example.

The printer 1000 comprises an ink supply station (ISS) 1100 and a printhead 1200.

The ISS 1100 may comprise a pump 1110 and an ink tank 1120, which are coupled to the ISS 1100. The ink tank 1120 may comprise an inflatable bag 1125. It should be appreciated that, although one ink tank is illustrated in FIG. 1 for purpose of simplicity, there may be several ink tanks which respectively contain different colors of ink. For example, four ink tanks 1120 may be employed for containing CMYK colors of ink. The pump 1110 is used to provide air pressure in the ink tank 1120 in order to deliver the ink. In an example, the pump 1110 may generate positive air pressure in the bag 1125 so as to inflate the bag 1125 in the ink tank 1120. This operation may be referred to as priming operation to the ink tank 1120. The air pressure may be held for a period of time and then the air may be vented by allowing the air to connect to ambient air. In an example, the venting may be performed by controlling a venting solenoid or a valve to allow the air to connect to ambient air.

The printhead 1200 may comprise an ink supply unit 1120 and a pump 1210, which are coupled to the printhead 1200. It should be appreciated that, although one ink supply unit is illustrated in FIG. 1 for purpose of simplicity, there may be several ink supply units which respectively contain different colors of ink. For example, four ink supply units 1120 may be employed for containing CMYK colors of ink. The printhead 1200 may be an off-axis printhead which may be used to print on large format medium. In an example, the off-axis printhead can move not only along a printhead scan axis but also along an off-axis direction during the printing. Accordingly, the ink supply unit 1220 may be an off-axis ink supply unit. The off-axis ink supply unit 1220 comprises an inflatable bag 1225.

In an example, the pump 1210 may generate positive air pressure in the bag 1225 so as to inflate the bag 1225 in the ink supply 1220. This operation may be referred to as priming operation to the ink supply 1220. The air pressure may be held for a period of time and then may be vented by allowing the inside air to connect to ambient air. In an example, the venting may be performed by using a venting solenoid or a valve to allow the air to connect to ambient air. In an example, when the printhead moves along the off-axis moving direction to a position, the off-axis ink supply 220 is coupled to the pump 1220. This position may be referred to as an off-axis air coupling position, and when the printhead 1200 moves to the off-axis air coupling position, the printhead 1200 is engaged with the pump 1210. Upon engagement with the printhead 1200, the pump 1210 may prime the off-axis ink supply 220 by providing air pressure, the air pressure may be held by keeping the printhead at the air coupling position, and the air may be vented by disengaging the printhead 1200 from the pump 1210, i.e., by moving the printhead away from the air coupling position.

In an example, the off-axis ink supply unit 1220 may be a relative low volume ink reservoir for the purpose of allowing the printhead 1200 to be in compact size and cost effective. The ink tank 1120 may be a high volume ink reservoir in comparison to the ink containable within the off-axis ink supply unit 1220.

The printer 1000 may comprise a connection unit which is used to connect the ISS 1100 to the printhead 1200, and particularly to the off-axis ink supply unit 1220. The connection unit may comprise a connector 1320 which is connected to the ISS 1100, a connector 1330 which is connected to the off-axis ink supply unit 1220, and a tube set 1310 connected between the connectors 1320 and 1330. The connector 1320 may be as gravitational fluid interconnector, which may utilize an effect of gravity to deliver the ink. The connector 1330 may be a detachable fluid interconnector, which allows the printhead to be easily detachable from the ISS and facilitates the maintenance and replacement of the off-axis printhead. The tube set 1310 may comprise several flexible tubes for delivering different colors of ink. For example, the tube set 1310 may comprise four tubes for transferring CMYK ink.

The ISS 1100, the printhead 1200 and the connection unit constitute an ink delivery system (IDS) for delivering the ink from the ISS 1100 to the printhead 1200. Particularly, the pumps 1110 and 1210, the ink tank 1120, the connectors 1320 and 1330, the tube 1310 and the off-axis ink supply 1220 constitute the IDS.

The printer 1000 may comprise a controller 1400 which controls the operation of the various components of the printer 1000 for delivering ink in the IDS. For example, the controller 1400 may execute instructions embodied in a computer readable medium to control the operation of the printer 1000. The controller 1400 may be implemented as a specific hardware, for example, the controller 1400 may be implemented as an Application Specific Integrated Circuit (ASIC) which controls the operation of the various components of the printer 1000. It should be appreciated that the controller 1400 may be implemented in the printhead 1200, although it is illustrated in FIG. 1 as being implemented out of the printhead.

The printer 1000 may comprise a sensor 1130 which is coupled to the ink tank 1120 and a sensor 1230 which is coupled to the off-axis ink supply unit 1220. The sensor 1130 is used to detect the ink level in the ink tank 1120 and the sensor 1230 is used to detect the ink level in the off-axis ink supply unit 1220. It should be appreciated that the sensor is not limited to any specific sensor, any kind of sensor which may detect the ink level is applicable in the printer 1000.

Figure 2:
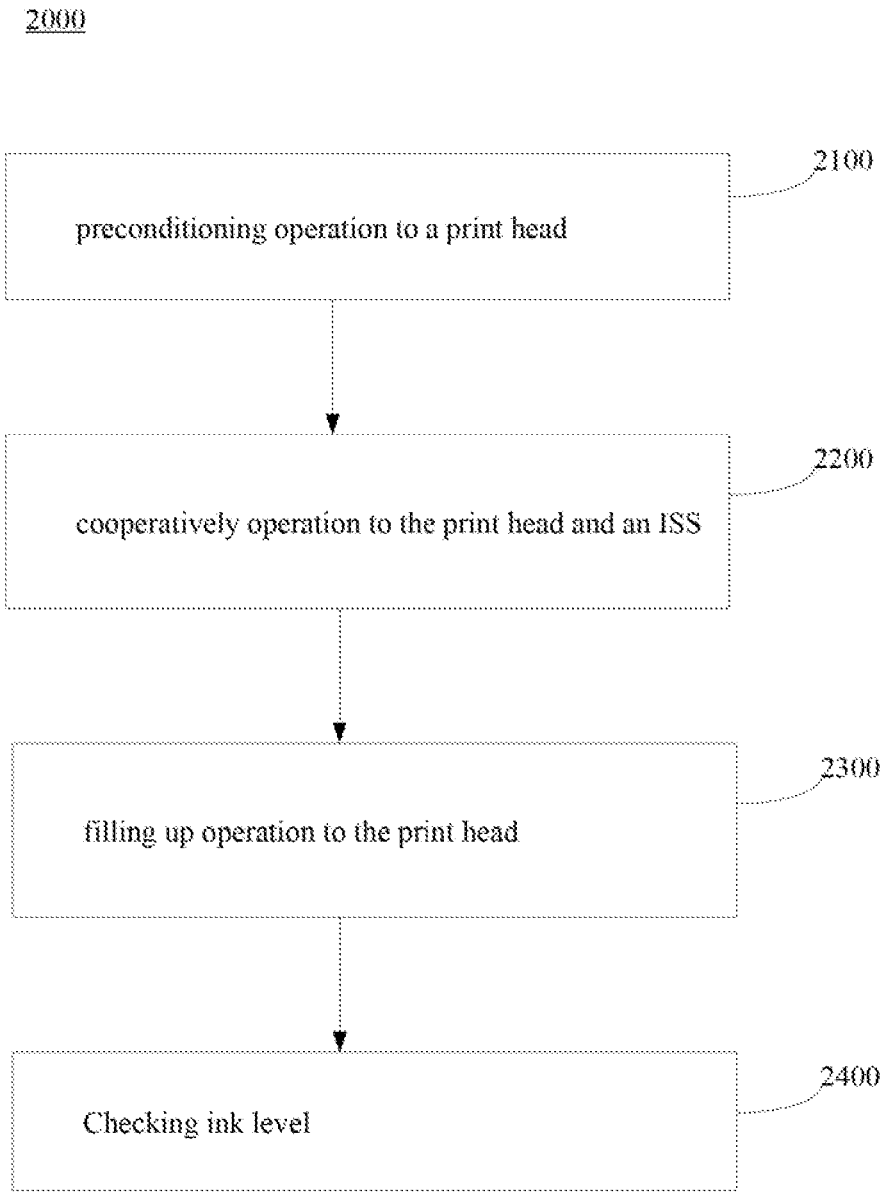
FIG. 2 shows a method for delivering ink from an ink supply station to a printhead according to an example.

FIG. 2 shows a method 2000 for delivering ink from an ISS to a printhead according to an example. This method may be used as a startup process of the printer 1000, and is performed when the printer 1000 is started or powered on in order to make the printer 1000 to be ready for printing.

At 2100, a preconditioning operation may be performed to a printhead. The printhead may be the printhead 1200 which has an off-axis ink supply unit 1220 and a pump 1210 coupled to the printhead. In an example, the preconditioning operation comprises the priming, holding and venting operations by using the pump 1210.

In an example, the pump 1210 may be controlled by the controller 1400 to generate positive air pressure in the bag 1225 to prime the ink supply 1220. The air pressure may be held for a period of time and then the air may be vented by allowing the inside air to connect to ambient air. In an example, the controller 1400 may control the printhead 1000 to move to the air coupling position for implementing the priming and holding operation, and move away from the air coupling position for implementing the venting operation.

At 2200, the printhead and an ISS may be cooperatively operated to deliver ink from the ISS to the printhead. In an example, the printhead 1200 and an ISS 1100 may be cooperatively operated, under the control of controller 1400, to deliver ink from the ISS 1100 to the printhead 1200 by using the pumps 1110 and 1210 to provide positive pressure to the ISS 1100 and the printhead 1200. For example, the priming operation to the ISS may be performed while the printhead is being hyperinflated, so as to deliver the ink from the ISS 1100 to the printhead 1200 through the cooperative operation of the ISS 1100 and the printhead 1200. In an example, the hyperinflation operation comprises priming and holding operation to the printhead 1200 by using the pump 1210.

At 2300, a filling up operation may be performed to the printhead 1200. In an example, the filling up operation may comprise performing first priming, holding and venting operations to the off-axis ink supply unit 1220 using the pump 1210. In an example, the filling up operation may comprise performing burp priming and venting using the pump 1210. The air pressure used in the burp priming is smaller than the air pressure used in the first priming of the filling up operation.

At 2400, ink level in the off-axis ink supply unit 1220 and ink level in the ink tank 1120 are checked. In an example, the ink levels may be checked by using the ink level sensors 1130 and 1230. If the ink level in the off-axis ink supply unit 1220 is above or not below a first threshold and the ink level in the ink tank 1120 is above or not below a second threshold, the ink delivery process is completed.

Figure 3:
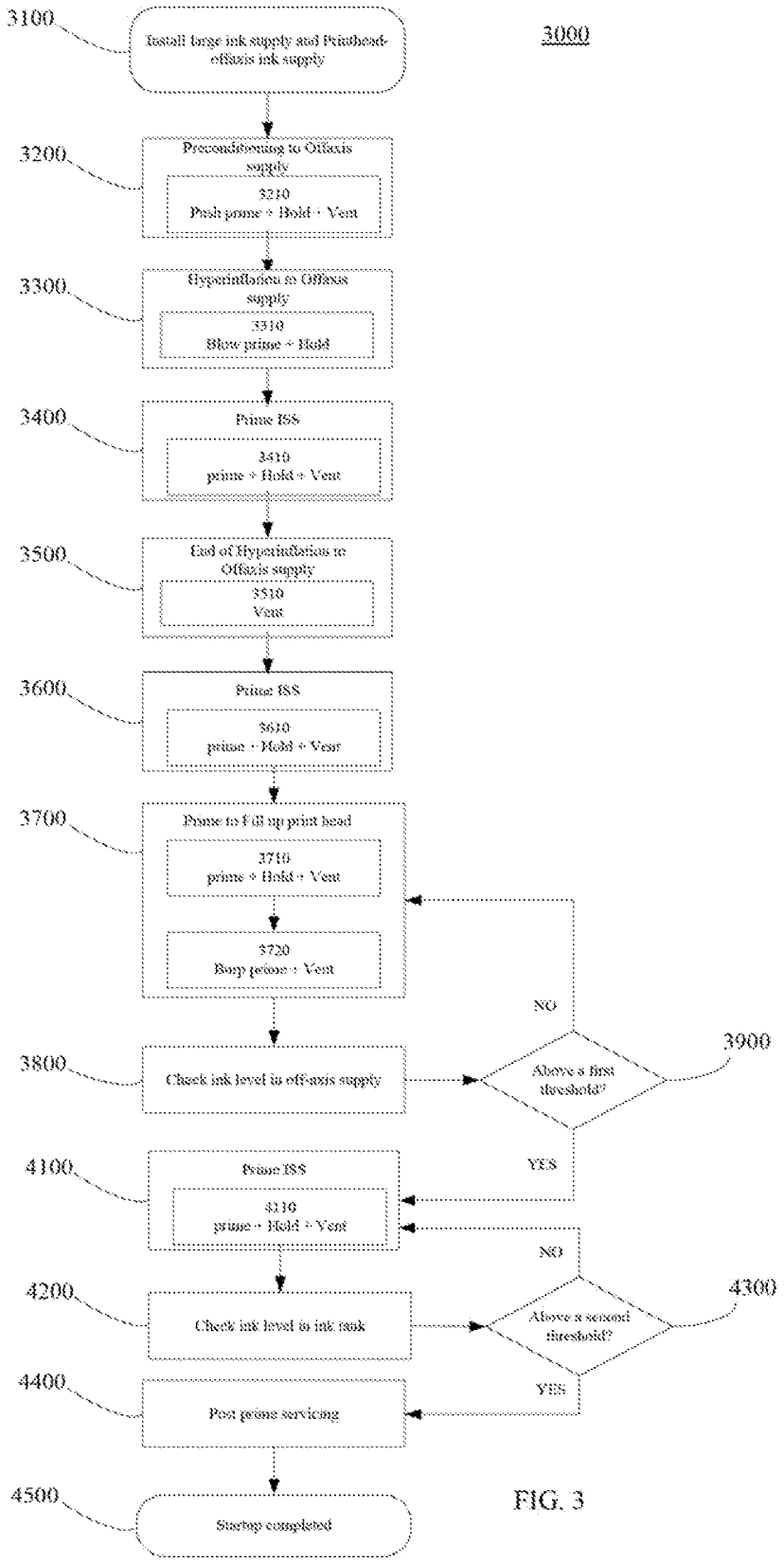
FIG. 3 shows a method for delivering ink from an ink supply station to a printhead according to an example.

FIG. 3 shows a method 3000 for delivering ink from an ISS to a printhead according to an example. This method may be used as a startup process of the printer 1000, and is performed when the printer 1000 is started or powered on in order to make the printer 1000 to be ready for printing.

The process for delivering ink is started after the high volume ink supply (e.g. ink tank 1120) and the off-axis ink supply (e.g. off-axis ink supply 1220) of the printhead are installed as shown in 3100. For purpose of clarity and by way of example, the method 3000 is described with reference to the printer 1000 shown in FIG. 1.

At 3200, a preconditioning operation may be performed to the off-axis ink supply 1220 of the printhead 1200. As shown at 3210, the preconditioning operation may comprise performing priming, holding and venting operations by using the pump 1210. In an example, the priming operation in the preconditioning operation may be referred to as push priming, which is performed by using the pump 1210 to generate a first an pressure. In an example the priming, holding and venting operations in the preconditioning operation may be performed for a predetermined number of cycles. For example, the cycle of priming, holding and venting operations may be performed for three times in the preconditioning operation. It should be appreciated that the predetermined number of cycles is not limited.

At 3300, a hyperinflation operation may be performed to the off-axis ink supply unit 1220 coupled to the printhead 1200. As shown at 3310, the hyperinflation operation may comprise priming and holding operation by using the pump 1210 coupled to the printhead 1200. In an example, the priming operation in the hyperinflation operation may be referred to as blow priming, which is performed by using the pump 1210 to generate a second air pressure. The hyperinflation operation hyperinflates an inflatable bag, such as the bag 1225, to a pressure based on the priming and holding operations, thereby facilitating the delivery of the ink from the ISS 1100 to the off-axis ink supply unit 1220.

At 3400, while the hyperinflation to the off-axis ink supply unit 1220 is being held as shown at 3310, an ISS prime cycle is performed to ink tank 1120 of the ISS 1100. As shown at 3410, the prime cycle to ink tank 1120 may comprise priming, holding and venting operations by using the pump 1110. The priming operation is an operation by a component of the printer, such as the pump 1110, that primes fluid such as air into a space of the ink tank 1120. The holding operation is an operation by a component of the printer, such as the pump 1110, that hold the fluid in the space of the ink tank 1120. The venting operation is an operation by a component of the printer, such as a valve, that vents fluid from the space of the ink tank 1120. In an example, the priming, holding and venting operations to the ink tank 1120 may be performed for a predetermined number of cycles. For example, the ISS prime cycle of priming, holding and venting operations may be performed for eight times. It should be appreciated that the predetermined number of cycles is not limited.

At 3500, venting operation is performed to the off-axis ink supply unit 1220 coupled to the printhead 1200.

At 3600, an ISS prime cycle is performed to ink tank 1120 of the ISS 1100. As shown at 3610, the prime cycle to ink tank 1120 may comprise priming, holding and venting operations by using the pump 1110. In an example, the priming, holding and venting operations to the ink tank 1120 may be performed for a predetermined number of cycles. For example, the ISS prime cycle of priming, holding and venting operations may be performed for twice. It should be appreciated that the predetermined number of cycles is not limited.

At 3700, a filling up operation may be performed to the printhead 1200. As shown at 3710 and 3720, the filling up operation may comprise performing first priming, holding and venting operations to the off-axis ink supply unit 1220 using the pump 1210, and the filling up operation may further comprise performing burp priming and venting using the pump 1210. In an example, the first priming, holding and venting operations to the off-axis ink supply unit 1220 may be performed for a first predetermined number of cycles, and the burp priming and venting to the off-axis ink supply unit 1220 may be performed for a second predetermined number of cycles. For example, the first predetermined number of cycles may be one, and the second predetermined number of cycles may be sixteen. It should be appreciated that the predetermined numbers of cycles are not limited. In an example, the numbers of cycles may be dynamic. For example, the numbers of cycles may be increased if the sensed ink level in the ink supply unit 1220 is not above a threshold.

In an example, the burp priming may be performed by using the pump 1210 to generate a third air pressure. In an example, the first an pressure used for the push priming in the preconditioning operation at 3210 is larger than the second air pressure used for the blow priming in the hyperinflation operation at 3310, and the second air pressure used for the blow priming is larger than the third air pressure used for the burp priming in filling up printhead operation at 3720.

At 3800, ink level in the off-axis ink supply unit 1220 is checked. In an example, the ink level may be checked by using the ink level sensor 1230. If the ink level in the off-axis ink supply unit 1220 is determined as below or not above a first threshold as shown at 3900, the method returns to 3700, in which the filling up printhead operation is performed. If the ink level in the off-axis ink supply unit 1220 is above or not below the first threshold, the method proceeds to 4100.

At 4100, an ISS prime cycle is performed to ink tank 1120 of the ISS 1100. As shown at 4110, the prime cycle to ink tank 1120 may comprise priming, holding and venting operations by using the pump 1110. In an example, the priming, holding and venting operations to the ink tank 1120 may be performed for a predetermined number of cycles. For example, the ISS prime cycle of priming, holding and venting operations may be performed for twice. It should be appreciated that the predetermined number of cycles is not limited. In an example, the number of cycles may be dynamic. For example, the number of cycles may be increased if the sensed ink level in the ink tank 1120 is not above a threshold.

At 4200, ink level in the ink tank 1120 is checked. In an example, the ink level may be checked by using the ink level sensor 1130. If the ink level in the ink tank 1120 is determined as below or not above a second threshold as shown at 4300, the method returns to 4100, in which the ISS prime cycles are performed. If the ink level in the ink tank 1120 is above or not below the second threshold, the ink delivery process is completed and the method proceeds to 4400.

At 4400, prime servicing may be posted. In an example, a printhead cleaning serving may be performed at 4400. Then the startup process of the printer is completed as shown at 4500, and a ready notification may be signaled for example on the screen of the printer.

FIGS. 2 and 3 illustrate various methods according to the claimed subject matters. While, for purpose of simplicity of explanation, the methods are shown and described as a series of acts, it is to be appreciated that the claimed subject matter is not limited by the order of acts, as some acts may occur in different orders and/or concurrently with other acts from some other acts. It is to be appreciated some details are described in order for understanding of the technique, the claimed subject matter is not limited by each and every specific detail described. For example, the loop of 3700, 3800 and 3900 may be performed before the loop of 4100, 4200 and 4300, and the two loops may be performed in other orders or in parallel. For example, the ISS prime cycle at 3600 may not be performed.

In an example, although it's not shown in the FIG. 2, an exception handling process may be performed for the determining blocks 3900 and 4300. For example, if the answer of block 3900 is No for a predetermined number of times, an error notification may be signaled and the process may be interrupted. Similarly, if the answer of block 4300 is No for a predetermined number of times, an error notification may be signaled and the process may be interrupted.

Referring back to FIG. 1, the controller 1400 may operate to control the various components of the printhead to perform the various operations as described in conjunction with FIGS. 2 and 3.

In an example, the controller 1400 is to perform a preconditioning operation to the printhead 1200, the preconditioning operation comprising priming, holding and venting operations by using the first pump 1210; cooperatively operate the ISS 1100 and the printhead 1200 to deliver ink from the ISS to the printhead by using the first pump 1210 and the second pump 1110 to provide positive pressure to the printhead and the ISS; and check ink level in the off-axis ink supply unit 1220 coupled to the printhead 1200 and ink level in the ink tank 1120 coupled to the ISS 1100.

In an example, the controller 1400 is further to perform the filling up operation to the printhead 1200 if the checked ink level in the off-axis ink supply unit 1220 is below a first threshold, wherein the filling up operation comprises performing priming, holding and venting operations to the off-axis ink supply unit 1220 for a first predetermined number of cycles by generating a first pressure using the first pump 1210 and performing burp priming and venting operations to the off-axis ink supply unit 1220 for a second predetermined number of cycles by generating a second pressure using the first pump 1210, wherein the first pressure is larger than the second pressure.

In an example, the controller 1400 is further to perform priming, holding and venting to the ISS 1100 for a third predetermined number of cycles by using the second pump 1110 if the checked ink level in the ink tank 1120 is below a second threshold.

In an example, the controller 1400 is further to perform hyperinflation operation to the off-axis ink supply unit 1220 coupled to the printhead 1200, the hyperinflation operation comprising priming and holding operation by using the first pump 1210 coupled to the printhead 1200; perform priming, holding and venting to the ISS 1100 for a third predetermined number of cycles by using the second pump 1110 while the holding operation is performed to the off-axis ink supply unit 1220; and perform venting operation to the off-axis ink supply unit 1220 coupled to the printhead 1200.

In an example, the controller is further to perform priming, holding and venting operations to the ISS 1100 for a fourth predetermined number of cycles by using the second pump 1110 after the performing venting operation to the off-axis ink supply unit 1220 coupled to the printhead.

In an example, the controller is further to generate a signal indicating that the printer 1000 is ready for printing after the checked ink level in the off-axis ink supply unit 1220 coupled to the printhead 1200 is above a first predetermined threshold and the checked ink level in the ink tank 1120 coupled to the ISS 1100 is above a second predetermined threshold.

The foregoing disclosure describes a number of examples for implementing a printer and a method for delivering ink in the IDS of the printer. It should be appreciated the described examples intend to illustrate rather than limiting the claimed subject matter. Thus the claims are not intended to be limited to the illustrated details of the examples, but are to be accorded the full scope consistent with the language of the claims.

The invention claimed is:

1. A method for delivering ink, comprising performing a preconditioning operation to a printhead having an off-axis ink supply unit and a first pump coupled to the printhead, the preconditioning operation comprises priming, holding and venting operations by using the first pump;

cooperatively operating the printhead and an ink supply station (ISS), which has a second pump coupled to the ISS, to deliver ink from the ISS to the printhead by using the first pump and the second pump to provide positive pressure to the printhead and the ISS, wherein the cooperatively operating the printhead and the ISS comprises:

performing hyperinflation operation to the off-axis ink supply unit coupled to the printhead, the hyperinflation operation comprises priming and holding operation by using the first pump coupled to the printhead;

performing priming, holding and venting to the ISS by using the second pump while the holding operation is performed to the off-axis ink supply unit; and performing venting operation to the off-axis ink supply unit coupled to the printhead; and performing a filling up operation to the printhead, the filling up operation comprises performing priming, holding and venting operations to the off-axis ink supply unit using the first pump.

2. The method of claim 1, wherein the cooperatively operating the printhead and the ISS further comprises performing priming, holding and venting operations to the ISS by using the second pump after the performing venting operation to the off-axis ink supply unit coupled to the printhead.

3. The method of claim 2, wherein the filling up operation to the printhead further comprises performing burp priming and venting using the first pump.

4. The method of claim 3, wherein the priming operation in the preconditioning is performed using a first pressure, the priming operation in the hyperinflation operation is performed using a second pressure, and the burp priming operation in the filling up operation is performed using a third pressure, wherein the first pressure is larger than the second pressure, and the second pressure is larger than the third pressure.

5. The method of claim 1, further comprising checking ink level in the off-axis ink supply unit and ink level in the ink tank;

performing the filling up operation to the printhead if the checked ink level in the off-axis ink supply unit is below a first threshold; and performing priming, holding and venting to the ISS by using the second pump if the checked ink level in the ink tank is below a second threshold.

6. A printer, comprising a printhead having an off-axis ink supply unit and a first pump coupled to the printhead;

an ink supply station (ISS) having a second pump and an ink tank coupled to the ISS; and a controller to:

perform a preconditioning operation to the printhead, the preconditioning operation comprising priming, holding and venting operations by using the first pump;

cooperatively operate the ISS and the printhead to deliver ink from the ISS to the printhead by using the first pump and the second pump to provide positive pressure to the printhead and the ISS;

check ink level in the off-axis ink supply unit coupled to the printhead and ink level in the ink tank coupled to the ISS;

perform the filling up operation to the printhead if the checked ink level in the off-axis ink supply unit is below a first threshold, wherein the filling up operation comprises performing priming, holding and venting operations to the off-axis ink supply unit for a first predetermined number of cycles by generating a first pressure using the first pump and performing burp priming and venting operations for a second predetermined number of cycles by generating a second pressure using the first pump, wherein the first pressure is larger than the second pressure; and perform priming, holding and venting to the ISS for a third predetermined number of cycles by using the second pump if the checked ink level in the ink tank is below a second threshold.

7. The printer of claim 6, wherein the controller is further to:

perform hyperinflation operation to the off-axis ink supply unit coupled to the printhead, the hyperinflation operation comprising priming and holding operation by using the first pump coupled to the printhead;

perform priming, holding and venting to the ISS for a third predetermined number of cycles by using the second pump while the holding operation is performed to the off-axis ink supply unit; and perform venting operation to the off-axis ink supply unit coupled to the printhead.

8. The printer of claim 7, wherein the controller is further to:

perform priming, holding and venting operations to the ISS for a fourth predetermined number of cycles by using the second pump after the performing venting operation to the off-axis ink supply unit coupled to the printhead.

9. The printer of claim 6, wherein the controller is further to:

generate a signal indicating that the printer is ready for printing after the checked ink level in the off-axis ink supply unit coupled to the printhead is above a first predetermined threshold and the checked ink level in the ink tank coupled to the ISS is above a second predetermined threshold.

* * * * *